US007874083B1

(12) United States Patent
Tillman

(10) Patent No.: US 7,874,083 B1
(45) Date of Patent: Jan. 25, 2011

(54) SOLE WEAR PROTECTION SYSTEM

(76) Inventor: Kiheim Tillman, 15 Victor St., Apartment #6, Lodi, NJ (US) 07644-2523

( * ) Notice: Subject to any disclaimer, the term of this patent is extended or adjusted under 35 U.S.C. 154(b) by 839 days.

(21) Appl. No.: 11/761,238

(22) Filed: Jun. 11, 2007

(51) Int. Cl.
*A43B 13/22* (2006.01)

(52) U.S. Cl. ..... 36/15; 36/72 R; 36/73

(58) Field of Classification Search ..... 36/15, 36/72 R, 73, 74, 82, 42, 72 B, 100, 101, 36 R
See application file for complete search history.

(56) References Cited

U.S. PATENT DOCUMENTS

| | | | | | |
|---|---|---|---|---|---|
| 1,772,069 | A | | 8/1930 | Collier et al. | |
| 1,891,515 | A | * | 12/1932 | Weinstein | 36/74 |
| 1,930,874 | A | * | 10/1933 | Byrd | 36/73 |
| 3,318,026 | A | * | 5/1967 | Antelo | 36/42 |
| 3,456,367 | A | * | 7/1969 | Mills | 36/74 |
| 3,481,053 | A | * | 12/1969 | De Felice | 36/36 R |
| 3,526,976 | A | * | 9/1970 | Jacobs | 36/100 |
| 3,561,140 | A | * | 2/1971 | Ludwig | 36/59 R |
| 3,852,898 | A | * | 12/1974 | Rubens | 36/73 |
| 3,858,336 | A | | 1/1975 | Brown | |
| 3,934,359 | A | * | 1/1976 | Fletcher | 36/73 |
| 4,246,706 | A | * | 1/1981 | Persons, Jr. | 36/73 |
| 4,318,232 | A | * | 3/1982 | Ching | 36/73 |
| 4,494,323 | A | | 1/1985 | Latraverse | |
| 4,573,279 | A | | 3/1986 | Feurer-Zogel et al. | |
| D301,392 | S | | 6/1989 | Le | |
| 4,887,369 | A | * | 12/1989 | Bailey et al. | 36/101 |
| 4,942,677 | A | | 7/1990 | Flemming | |
| 6,510,625 | B2 | * | 1/2003 | Sato et al. | 36/36 R |
| 7,246,453 | B2 | * | 7/2007 | Kim | 36/15 |

* cited by examiner

*Primary Examiner*—Marie Patterson

(57) ABSTRACT

A sole wear protection system for minimizing wear to a sole of a shoe includes a shoe being worn on a foot. The shoe includes an upper positioned over the foot when the shoe is being worn. The shoe includes a sole coupled to the upper and positioned under the foot when the shoe is being worn. A plurality of sleeves extends into the sole of the shoe. Each of the sleeves includes an open bottom end. A plurality of plate assemblies is mountable to sleeves. The plate assemblies are positioned between the sole and a support surface to minimize contact between the sole and the support surface.

8 Claims, 4 Drawing Sheets

SOLE WEAR PROTECTION SYSTEM

BACKGROUND OF THE INVENTION

1. Field of the Invention

The present invention relates to removable outsoles and more particularly pertains to a new removable outsole for minimizing wear to a sole of a shoe.

2. Description of the Prior Art

The use of removable outsoles is known in the prior art. While these devices fulfill their respective, particular objectives and requirements, the need remains for a system that has certain improved features that allow for the system to protect specific areas of a sole of a shoe from wear without changing the appearance of the shoe. Additionally, the system should include sleeves in various configurations to allow plate assemblies of the system to be arranged in a variety of configurations.

SUMMARY OF THE INVENTION

The present invention meets the needs presented above by generally comprising a shoe being worn on a foot. The shoe includes an upper positioned over the foot when the shoe is being worn. The shoe includes a sole coupled to the upper and positioned under the foot when the shoe is being worn. A plurality of sleeves extends into the sole of the shoe. Each of the sleeves includes an open bottom end. A plurality of plate assemblies is mountable to sleeves. The plate assemblies are positioned between the sole and a support surface to minimize contact between the sole and the support surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
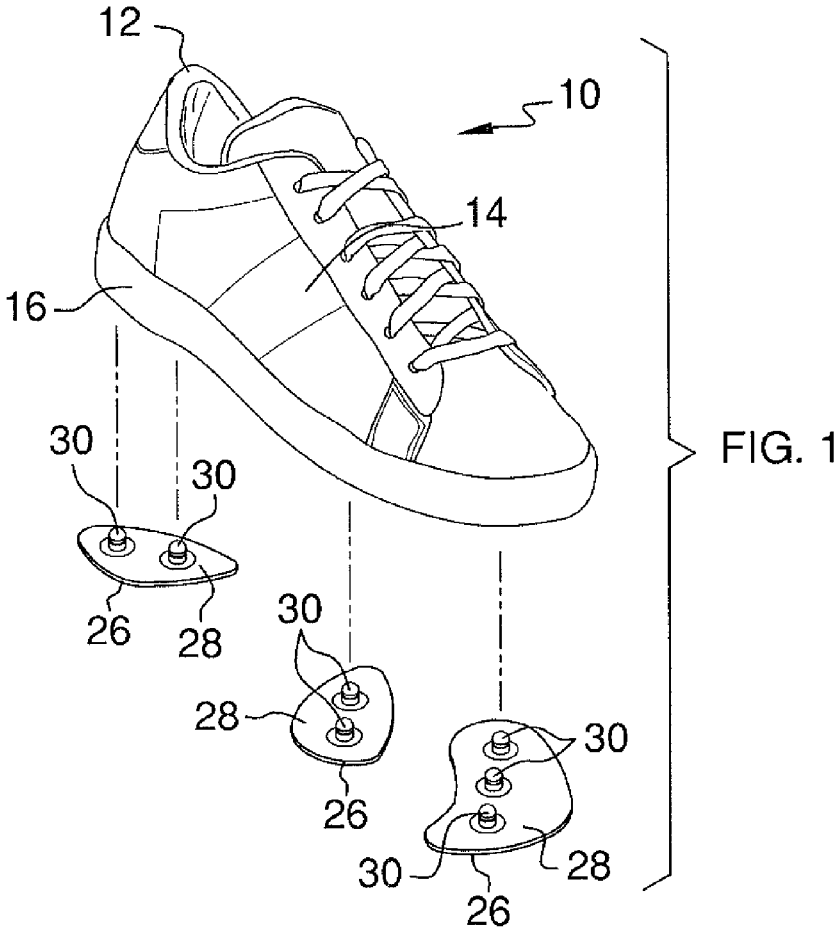
FIG. 1 is an exploded perspective view of a sole wear protection system according to the present invention.
Figure 2:
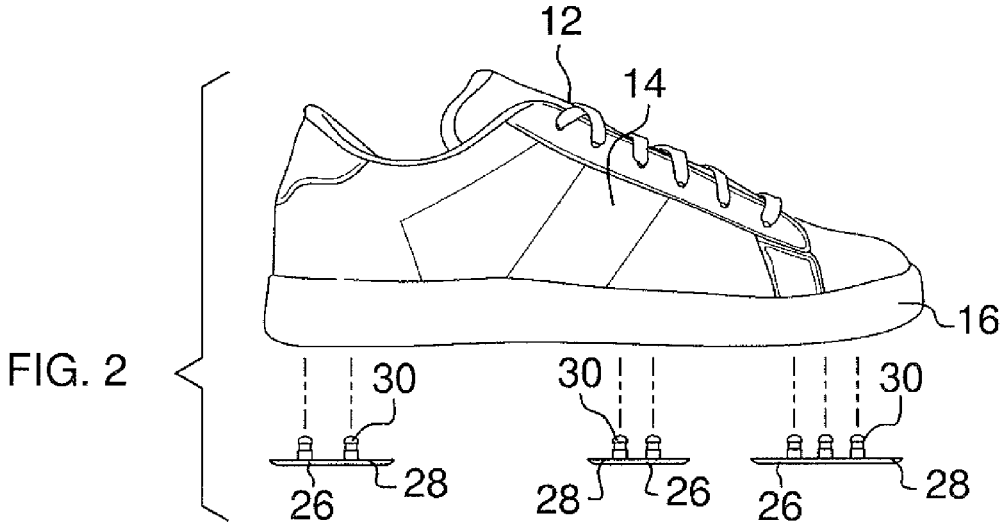
FIG. 2 is an exploded side view of the present invention.
Figure 3:
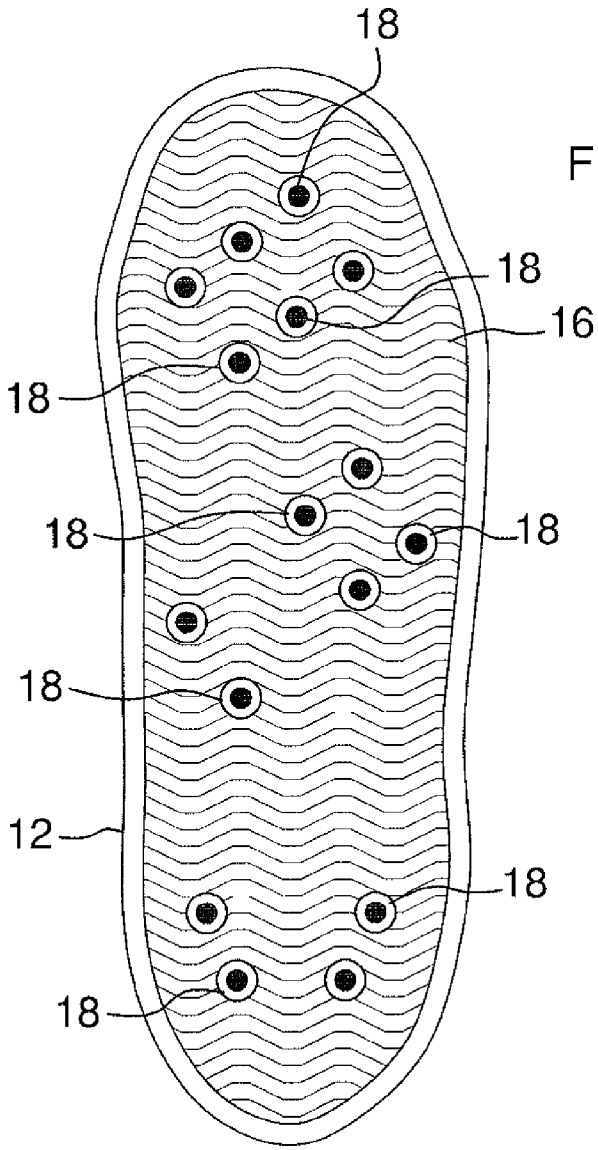
FIG. 3 is a bottom view of a sole of the present invention for a left foot.
Figure 4:
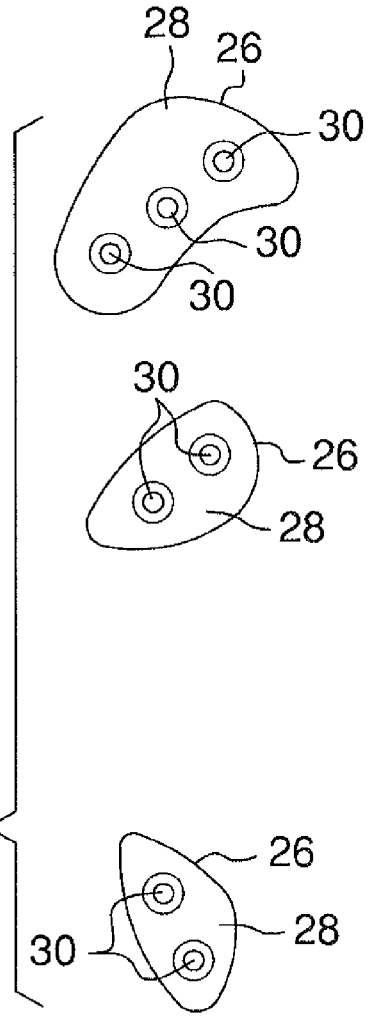
FIG. 4 is a top view plate assemblies of the present invention.
Figure 5:
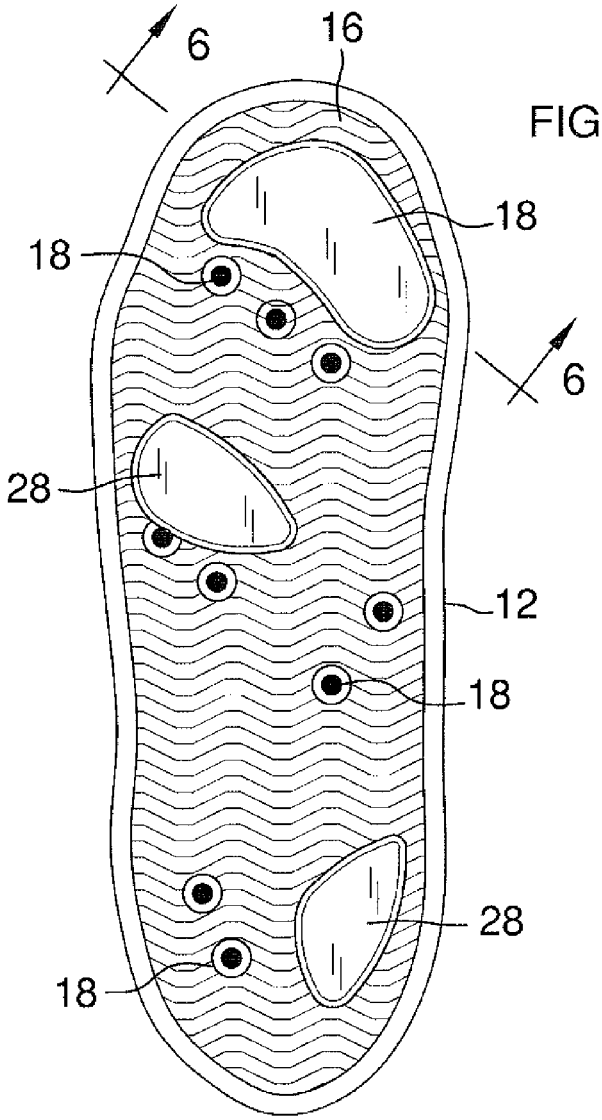
FIG. 5 is a bottom view of the sole of the present invention for a right foot with the plate assemblies in place.
Figure 6:
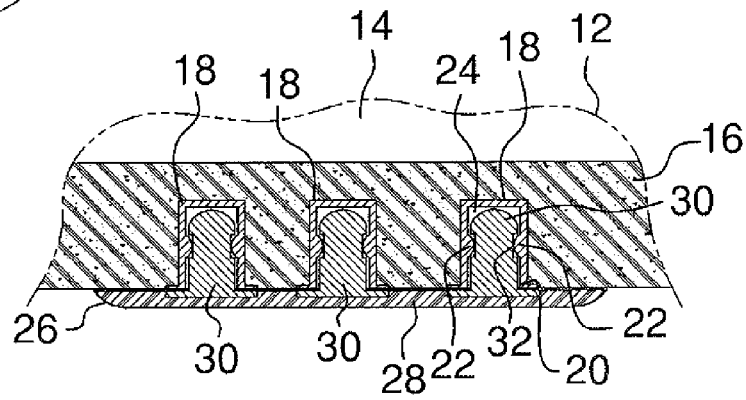
FIG. 6 is a cross-sectional view of the present invention taken along line 6-6 of FIG. 5.

With reference now to the drawings, and in particular to FIGS. 1 through 7 thereof, a new removable outsole embodying the principles and concepts of the present invention and generally designated by the reference numeral 10 will be described.

As best illustrated in FIGS. 1 through 7, the sole 16 wear protection system 10 generally comprises a shoe 12 being worn on a foot. The shoe 12 includes an upper 14 being positioned over the foot when the shoe 12 is being worn. The shoe 12 includes a sole 16 coupled to the upper 14 and being positioned under the foot when the shoe 12 is being worn.

A plurality of sleeves 18 extends into the sole 16 of the shoe 12. Each of the sleeves 18 includes an open bottom end 20. Each of the sleeves 18 includes a pair of nubs 22 extending into a bore 24 of the associated one of the sleeves 18. The nubs 22 are approximately centrally located along a length of the associated one of the sleeves 18.

A plurality of plate assemblies 26 is mountable to the sleeves 18. The plate assemblies 26 are positioned between the sole 16 and a support surface to minimize contact between the sole 16 and the support surface. Each of the plate assemblies 26 includes a wear plate 28 mountable to the sole 16 of the shoe 12. The wear plate 28 is comprised of a flexible friction enhancing material, such as rubber, to frictionally engage the support surface.

Each of the plate assemblies 26 also includes a plurality of lugs 30 coupled to the wear plate 28. The open bottom end 20 of one of the sleeves 18 receives one of the lugs 30 therein to mount the wear plate 28 to the sole 16. Each of the lugs 30 includes a necked section 32 to receive the lugs 30 of the associated one of the sleeves 18 to inhibit inadvertent removal of the lugs 30 from the sleeves 18. The necked section 32 is approximately centrally located along a length of the associated one the lugs 30.

A portion of the sleeves 18 are positioned to position one of the plate assemblies 26 under toes of the foot. A portion of the sleeves 18 are positioned to position one of the plate assemblies 26 under a ball of the foot. Another portion of the sleeves 18 are positioned to position one of the plate assemblies 26 under a heel of the foot.

Figure 7:
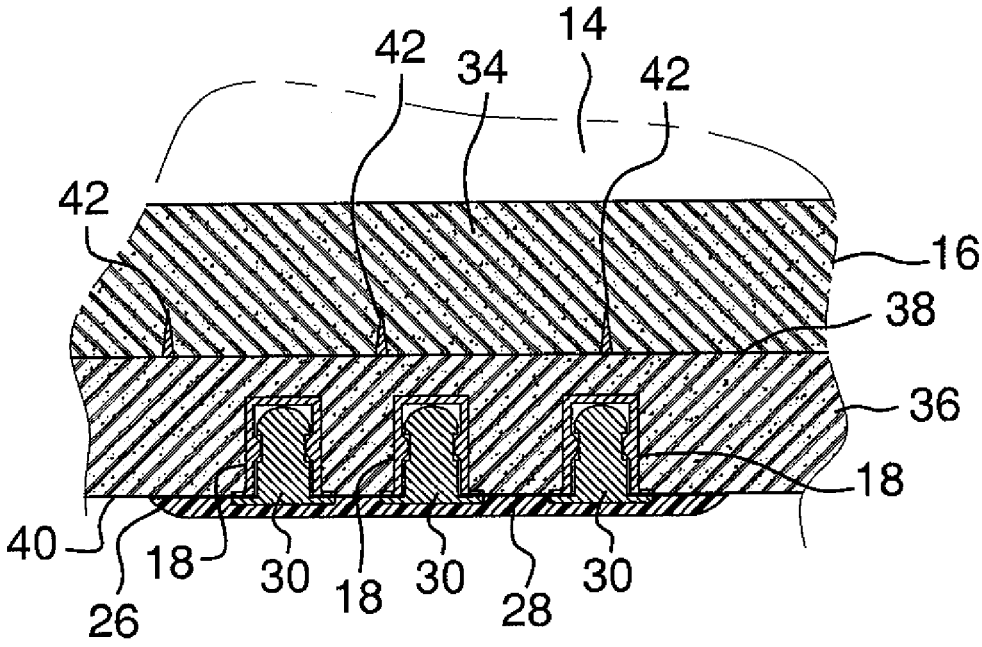
FIG. 7 is the cross-sectional view from FIG. 6 of an embodiment of the sole of the present invention.

In an embodiment, as shown in FIG. 7, the sole 16 of the shoe 12 includes a mounted plate 34 coupled to the upper 14 of the shoe 12. The sole 16 includes a removable plate 36 mounted to a bottom face 38 of the mounted plate 34 opposite the upper 14. The sleeves 18 extend into the removable plate 36 through a lower face 40 of the removable plate 36. The removable plate 36 is removed from the mounted plate 34 and replaced when the removable plate 36 is damaged. A plurality of anchors 42 is attached to the removable plate 36 and is removably extended into the mounted plate 34.

In use, the lugs 30 of one of the plate assemblies 26 are inserted into a portion of the sleeves 18 to position the associated wear plate 28 under the sole 16 of the shoe 12. Multiple wear plates 28 are used to protect the sole 16 from being worn down by contact with the support surface. The positioning of the sleeves 18 allows the wear plates 28 to be positioned on the sole 16 in places where the greatest amount of contact between the sole 16 and the support surface occurs.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sole wear protection system for reducing wear on the sole of a shoe, said system comprising:

a shoe being worn on a foot, said shoe including an upper being positioned over the foot when said shoe is being worn, said shoe including a sole being coupled to said upper and being positioned under the foot when the shoe is being worn;

a plurality of sleeves extending into said sole of said shoe, each of said sleeves including an open bottom end;

a plurality of plate assemblies being mountable to sleeves, said plate assemblies being positioned between said sole and a support surface to minimize contact between said sole and the support surface; and said sole of said shoe includes a mounted plate coupled to said upper of said shoe, said sole including a removable plate being mounted to a bottom face of said mounted plate opposite said upper, said sleeves extending into said removable plate through a lower face of said removable plate, said removable plate being removed from said mounted plate and replaced when said removable plate is damaged.

2. The system according to claim 1, wherein each of said plate assemblies includes a wear plate mountable to said sole of said shoe.

3. The system according to claim 2, wherein said wear plate is comprised of a flexible friction enhancing material to frictionally engage the support surface.

4. The system according to claim 2, wherein each of said plate assemblies includes a plurality of lugs being coupled to said wear plate, said open bottom end of one of said sleeves receiving one of said lugs therein to mount said wear plate to said sole.

5. The system according to claim 4, wherein each of said sleeves includes a pair of nubs extending into a bore of the associated one of said sleeves, said nubs being approximately centrally located along a length of the associated one of said sleeves.

6. The system according to claim 5, wherein each of said lugs includes a necked section to receive said lugs of the associated one of said sleeves to inhibit inadvertent removal of said lugs from said sleeves, said necked section being approximately centrally located along a length of the associated one said lugs.

7. The system according to claim 1, wherein said sleeves are positioned to position one of said plate assemblies under toes of the foot, said sleeves being positioned to position one of said plate assemblies under a ball of the foot, said sleeves being positioned to position one of said plate assemblies under a heel of the foot.

8. The system according to claim 1, further comprising a plurality of anchors being attached to said removable plate and being removably extended into said mounted plate.

* * * * *